US008682235B2

(12) United States Patent
Nojima

(10) Patent No.: US 8,682,235 B2
(45) Date of Patent: Mar. 25, 2014

(54) SHEET CONVEYING APPARATUS AND IMAGE FORMING APPARATUS

(75) Inventor: Hiroshi Nojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 13/303,741

(22) Filed: Nov. 23, 2011

(65) Prior Publication Data

US 2012/0134723 A1 May 31, 2012

(30) Foreign Application Priority Data

Nov. 30, 2010 (JP) ..... 2010-267566

(51) Int. Cl.
*G03G 15/16* (2006.01)

(52) U.S. Cl.
USPC ..... 399/316

(58) Field of Classification Search
USPC ..... 399/316, 317
See application file for complete search history.

(56) References Cited

U.S. PATENT DOCUMENTS

| | | | |
|---|---|---|---|
| 6,904,250 B2 | 6/2005 | Nemoto | |
| 7,706,734 B2 | 4/2010 | Higashimura et al. | |
| 8,019,264 B2 | 9/2011 | Murayama | |
| 2004/0228654 A1 | 11/2004 | Nemoto | |
| 2008/0122168 A1 * | 5/2008 | Higashimura et al. | 271/275 |
| 2008/0292371 A1 | 11/2008 | Murayama | |

FOREIGN PATENT DOCUMENTS

| | | | |
|---|---|---|---|
| CN | 1541924 | A | 11/2004 |
| CN | 1831671 | A | 9/2006 |
| CN | 2884267 | Y | 3/2007 |
| CN | 1326759 | C | 7/2007 |
| CN | 101118398 | A | 2/2008 |
| CN | 100527012 | C | 8/2009 |
| CN | 100576099 | C | 12/2009 |
| JP | 5-257395 | | 10/1993 |

* cited by examiner

*Primary Examiner* — Walter L Lindsay, Jr.
*Assistant Examiner* — Barnabas Fekete
(74) *Attorney, Agent, or Firm* — Canon USA Inc. IP Division

(57) ABSTRACT

A sheet conveying apparatus of the present invention includes a curved sheet conveying path provided between an upstream rotating member pair and a downstream rotating member pair, an elastic member, provided between the upstream rotating member pair and the downstream rotating member pair, configured to guide the sheet and to deform by being pressed by a rear end portion of the sheet conveyed by the downstream rotating member pair, a fixing portion configured to fix the elastic member, and a supporting portion, provided downstream of the fixing portion in the conveying direction, configured to support the elastic member from an opposite side of a guide surface of the elastic member guiding the conveyed sheet so that a portion of the elastic member between the fixing portion and the support portion is deflected along the curved sheet conveying path.

22 Claims, 8 Drawing Sheets

*FIG. 3*

| THICKNESS: t (mm) | WIDTH: b (mm) | BOTH-SIDE TAPE: c (mm) | | |
|---|---|---|---|---|
| | | 8 | 9 | 10 |
| 0.05 | 21.0 | INSPECTION IS NOT PERFORMED BECAUSE ITB MAY BE INTERFERED. | - | NOT GOOD |
| 0.05 | 21.5 | | - | NOT GOOD |
| 0.05 | 22.0 | | - | - |
| 0.05 | 23.0 | | - | - |
| 0.07 | 21.0 | | - | NOT GOOD |
| 0.07 | 21.5 | | GOOD | GOOD |
| 0.07 | 22.0 | | - | GOOD |
| 0.07 | 23.0 | | NO GOOD | GOOD |

*FIG. 7*

| NUMBER OF PASSED SHEETS | CHARGE AMOUNT (kV) | | |
|---|---|---|---|
| | FRONT | MIDDLE | BACK |
| 0 | - 0.44 | - 0.4 | - 0.49 |
| 50 | - 0.42 | - 0.38 | - 0.49 |
| 100 | - 0.4 | - 0.4 | - 0.5 |
| 150 | - 0.42 | - 0.41 | - 0.48 |
| 200 | - 0.42 | - 0.39 | - 0.49 |
| 250 | - 0.41 | - 0.4 | - 0.48 |
| MAX-MIN | 0.04 | 0.03 | 0.02 |

SHEET CONVEYING APPARATUS AND IMAGE FORMING APPARATUS

BACKGROUND OF THE INVENTION

1. Field of the Invention

The present invention relates to a sheet conveying apparatus and an image forming apparatus.

2. Description of the Related Art

In the prior art, an image forming apparatus such as a copying machine, a facsimile, and a printer includes a sheet conveying apparatus having a plurality of conveying rollers (rotating member pairs) and conveying a sheet to a transfer portion and a fixing portion by the conveying rollers. As such a sheet conveying apparatus, a sheet conveying path bent between the respective conveying rollers may be employed for the purpose of space-saving, the realization of high image quality, and so on.

A sheet is conveyed along a guide member, and if the sheet is deflected when the rear end of the sheet passes through the guide member, the sheet rear end is hopped by a restoring force due to the elasticity of the sheet itself. For example, when the sheet rear end passes through a pre-transfer guide provided on the upstream in a conveying direction of the transfer portion, the sheet rear end is hopped by the restoring force, whereby a transfer failure (image blur) occurs in an image formed on the sheet due to the shock of the hopping of the sheet rear end.

Thus, in the prior art, a pre-transfer guide includes an elastic member, for example, and when a sheet passes through the pre-transfer guide, the hopping of the sheet rear end is reduced by the elastic member (see, Japanese Patent Laid-Open No. 5-257395). Namely, even when the sheet rear end is hopped by the restoring force, the hopping of the sheet rear end is reduced by the elastic member, whereby the sheet can be conveyed smoothly.

In such prior art sheet conveying apparatus, the elastic member is fixed on the downstream in the conveying direction of the pre-transfer guide. However, when the elastic member is fixed on the downstream in the conveying direction of the pre-transfer guide thus, the deflection amount of the elastic member is limited. When the deflection amount is limited thus, an impact generated when the sheet passes cannot be reduced satisfactorily, and the effect of reduction of the image blur is limited.

Thus, the present invention provides a sheet conveying apparatus and an image forming apparatus which can reduce an impact, generated when a sheet passes, to reduce image blur.

SUMMARY OF THE INVENTION

A sheet conveying apparatus includes an upstream rotating member pair configured to convey a sheet, a downstream rotating member pair, configured to convey the sheet, provided downstream of the upstream rotating member pair in a conveying direction, a curved sheet conveying path provided between the upstream rotating member pair and the downstream rotating member pair, an elastic member, provided between the upstream rotating member pair and the downstream rotating member pair, configured to guide the sheet and to deform by being pressed by a rear end portion of the sheet conveyed by the downstream rotating member pair, a fixing portion configured to fix the elastic member, and a supporting portion, provided downstream of the fixing portion in the conveying direction, configured to support the elastic member from an opposite side of a guide surface of the elastic member guiding the conveyed sheet so that a portion of the elastic member between the fixing portion and the support portion is deflected along the curved sheet conveying path.

In the present invention, the impact generated when the sheet passes can be reduced.

Further features of the present invention will become apparent from the following description of exemplary embodiments with reference to the attached drawings.

BRIEF DESCRIPTION OF THE DRAWINGS

FIG. 3 is a diagram illustrating a configuration optimization test result of an impact absorption member applied to a left pre-transfer guide of the full color laser printer;

FIG. 7 is a view illustrating a change of a charge amount obtained when a recycled paper and 200% DUTY image are passed in the full color laser printer.

DESCRIPTION OF THE EMBODIMENTS

Figure 1:
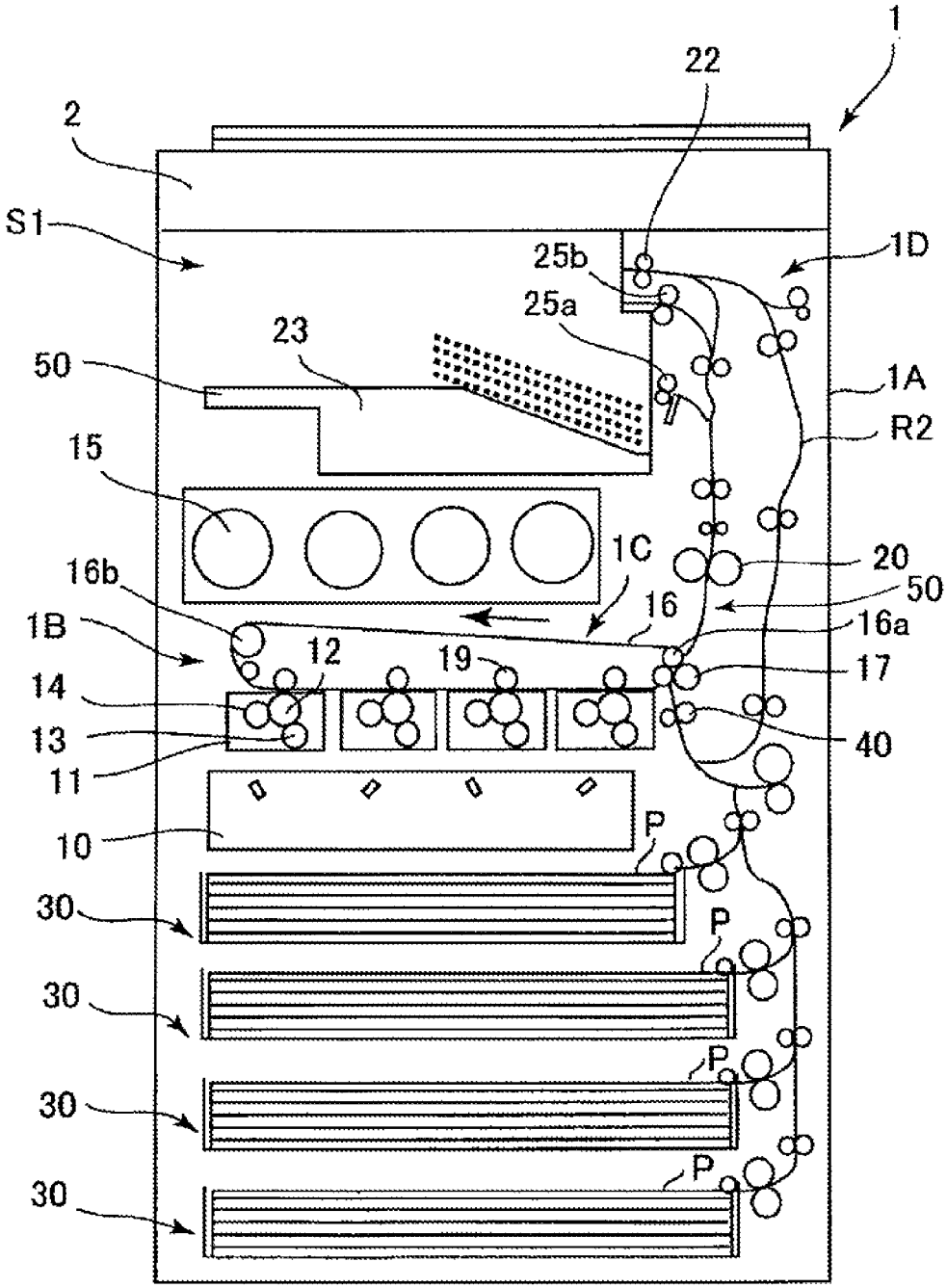
FIG. 1 is a view illustrating a schematic configuration of a full color laser printer which is an example of an image forming apparatus including a sheet conveying apparatus according to a first embodiment of the present invention.

Hereinafter, embodiments for practicing the present invention will be described in detail with reference to the drawings. FIG. 1 is a view illustrating a schematic configuration of a full color laser beam printer which is an example of an image forming apparatus including a sheet conveying apparatus according to a first embodiment of the present invention.

In FIG. 1, a full color laser beam printer (hereinafter referred to as a printer) 1 is provided with a printer body 1A as an image forming apparatus body, an image forming portion 1B forming an image on a sheet, and a fixing portion 20. An image reading apparatus 2 is an upper apparatus provided substantially horizontally above the printer body 1A, and a discharge space S1 for sheet discharge is provided between the image reading apparatus 2 and the printer body 1A. A sheet feeding apparatus 30 is provided at a lower portion of the printer body 1A. A sheet conveying apparatus 50 conveys a sheet by a plurality of rotating member pairs such as pairs of rollers. A toner cartridge 15 is provided in the printer body 1A.

The image forming portion 1B is of a four-drum full-color type and includes a laser scanner 10 and four process cartridges 11 forming toner images of four colors of yellow (Y), magenta (M), cyan (C), and black (K). The process cartridges 11 each include a photosensitive drum 12, a charger 13 as a charging portion, a development device 14 as a development unit, and a cleaner (not illustrated) as a cleaning unit. The image forming portion 1B includes an intermediate transfer unit 1C provided above a process cartridge 11.

The intermediate transfer unit 1C includes an intermediate transfer belt 16 wound around a drive roller 16*a* and a tension roller 16*b*. The intermediate transfer unit 1C includes a primary transfer roller 19 provided inside the intermediate transfer belt 16 and abutted against the intermediate transfer belt 16 at a position facing the photosensitive drum 12. The intermediate transfer belt 16 is constituted of a film-like member, arranged in contact with the respective photosensitive drums 12, and rotated in an arrow direction by the drive roller 16*a* driven by a driving portion (not illustrated).

A positive transfer bias is applied to the intermediate transfer belt 16 by the primary transfer roller 19, whereby the negative toner images of respective colors on the photosensitive drum are sequentially multiply transferred onto the intermediate transfer belt 16. Consequently, a color image is formed on the intermediate transfer belt. A secondary transfer roller 17 constituting a secondary transfer portion S which transfers a color image formed on the intermediate transfer belt onto a sheet P is provided at a position facing the drive roller 16*a* of the intermediate transfer unit 1C.

Further, a fixing portion 20 is arranged above the secondary transfer roller 17, and a first discharge roller pair 25*a*, a second discharge roller pair 25*b*, and a duplex inversion portion 1D which is an inversion sheet-discharge portion are arranged at the upper left portion of the fixing portion 20. The duplex inversion portion 1D is provided with an inversion roller pair 22 constituted of normally and reversely rotatable sheet inversion conveying rollers and a re-conveying path R2 through which a sheet with an image formed on its one side surface is conveyed to the image forming portion 1B again.

Next, the image forming operation of the printer 1 having the above constitution will be described. First, when image information of a manuscript is read by the image reading apparatus 2, the image information is subjected to image processing and then converted into an electrical signal to be transmitted to the laser scanner 10 of the image forming portion 1B. The image information may be input from an external device such as a personal computer (not illustrated) to the image forming portion 1B.

Then, in the image forming portion 1B, the surface of the photosensitive drum 12 of each of the process cartridges 11 is scanned by a laser beam emitted from the laser scanner 10 and corresponding to the image information of yellow, magenta, cyan, and black component colors. According to this constitution, the surfaces of the photosensitive drums 12 uniformly charged to predetermined polarity and potential by a charger 13 are sequentially exposed, and yellow, magenta, cyan, and black electrostatic latent images are sequentially formed on the photosensitive drums 12 of the respective process cartridges 11.

After that, the electrostatic latent images are developed by the respective toners of yellow, magenta, cyan, and black to be made visible. At the same time, by virtue of the use of a primary transfer bias applied to the primary transfer roller 19, the toner images of the respective colors on the photosensitive drums are sequentially superimposed on the intermediate transfer belt 16 to be transferred. According to this constitution, a toner image is formed on the intermediate transfer belt 16. The toner stored on the photosensitive drum 12 after the toner image transfer is removed by a cleaner.

The sheet P is fed out from the sheet feeding apparatus 30 in parallel with the toner image forming operation, and thereafter the sheet P is conveyed to a registration roller pair 40. The skew feeding of the sheet P is corrected by the registration roller pair 40, and, at the same time, the sheet P starts its rotation at a timing synchronized with the moving velocity of the toner image formed on the intermediate transfer belt 16. Along with the start of rotation, the sheet P is fed out from the registration roller pair 40 to a region between a left pre-transfer guide 37 and a right pre-transfer guide 39 and reaches a secondary transfer portion S constituted of the drive roller 16*a* and the secondary transfer roller 17.

During this time, when the conveyed state of the sheet P is not stable due to hopping and large vibration, the hopping and vibration of the sheet P can be reduced by an impact absorption member 36 fixed to the left pre-transfer guide 37. The operation of the impact absorption member 36 will be described later. Thereafter, in the secondary transfer portion S, the toner images are collectively transferred onto the sheet P by a secondary transfer bias applied to the secondary transfer roller 17. The toner stored on the intermediate transfer belt without being transferred in the secondary transfer portion S is collected by a cleaner (not illustrated).

Next, the sheet P onto which the toner image is transferred thus is conveyed to the fixing portion 20 to be subjected to the application of heat and pressure in the fixing portion 20, and the toners of the respective colors are melted and mixed to be fixed as a color image onto the sheet P. After that, the sheet P fixed with the image is discharged to a discharge space by the first discharge roller pair 25*a*, provided downstream of the fixing portion 20, to be placed on a placement portion 23 protruded toward a bottom surface of the discharge space.

Meanwhile, when images are formed on the both side surfaces of a sheet, the sheet on which an image is formed on its one side surface passes through the fixing portion 20, and thereafter, the rear end of the sheet P passes through the fixing portion 20 by a switch unit (not illustrated) and the inversion roller pair 22. After that, the inversion roller pair 22 is reversely rotated in a predetermined timing, whereby the sheet P is inverted to be conveyed to the re-conveying path R2 again and thereafter to be conveyed to the registration roller pair 40 again. Then, an image is formed on and fixed to the back surface of the sheet P again, and thereafter, the sheet P is discharged to the discharge space S1 by the first discharge roller pair 25*a* to be placed on the placement portion 23.

Figure 2A:
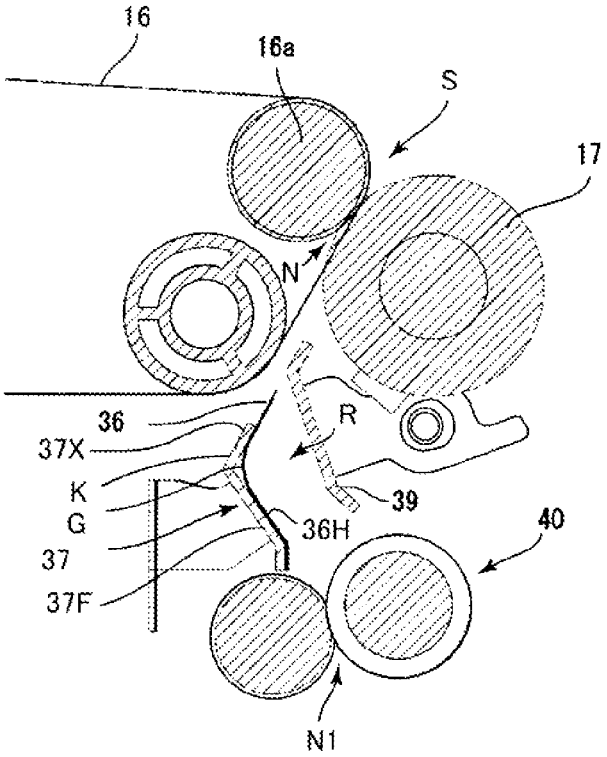
FIGS. 2A and 2B are views illustrating a configuration near a secondary transfer portion of the full color laser printer.
Figure 2B:
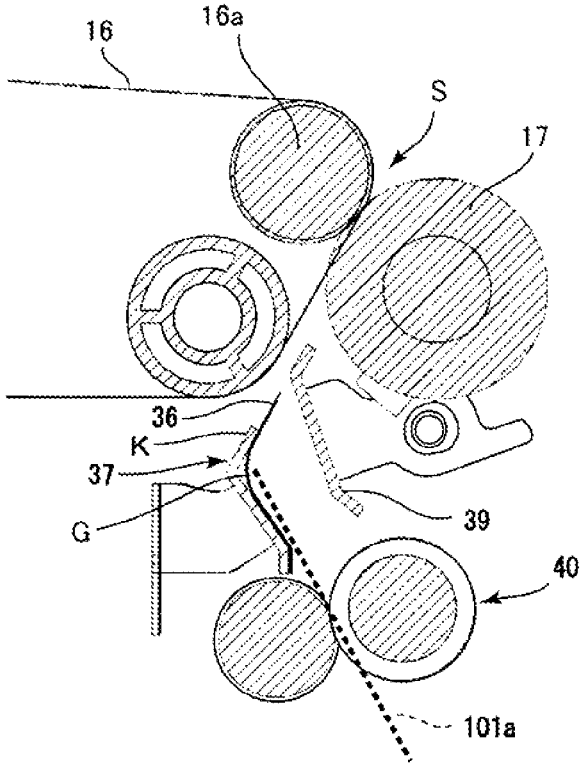

FIGS. 2A and 2B are views illustrating a configuration near the secondary transfer portion. In FIGS. 2A and 2B, a curved sheet conveying path R is provided between the registration roller pair 40 as an upstream rotating member pair and the drive roller 16*a* and the secondary transfer roller 17 as a downstream rotating member pair constituting the secondary transfer portion S and guides the sheet to the secondary transfer portion S. The left pre-transfer guide 37 is a curved guide member forming the sheet conveying path R, and the right pre-transfer guide 39 is provided to face the left pre-transfer guide 37 so that the sheet conveying path R is formed. The left pre-transfer guide 37 in the present embodiment does not guide the sheet by being directly in contact with the conveyed sheet but holds the impact absorption member 36 in contact with the sheet and guides the sheet through the impact absorption member 36. The left pre-transfer guide 37 is disposed on a side of the right pre-transfer guide 39 with respect to a nip line of the secondary transfer portion S. Therefore the sheet is conveyed in the state the trailing end portion of the sheet is deformed by the left pre-transfer guide 37. The left pre-transfer guide 37 and the right pre-transfer guide 39 have an electrical resistance unit such as a varistor (not illustrated), whereby the occurrence of an image failure due to charging and so on is prevented.

Among the two guides 37 and 39, a conveying direction downstream side end of the left pre-transfer guide 37 located inside the printer body is bent. In order to improve image quality (dot reproducibility and character scattering), the bent portion K of the left pre-transfer guide 37 is bent at such a degree that the sheet P can enter a transfer nip of the secondary transfer portion S.

In a case where the sheet conveying path R between the registration roller pair 40 and the secondary transfer portion S is curved, when the sheet rear end passes through the registration roller pair 40, the rear end of the sheet P is hopped by the rigidity (stiffness) of the sheet P to collide with the left pre-transfer guide 37. When the sheet rear end collides with the left pre-transfer guide 37 thus, the impact causes a transfer failure of the image formed on the sheet P. Thus, in the present embodiment, a sheet conveying direction upstream end of the left pre-transfer guide 37 is arranged at a position near a nip N1 of the registration roller pair 40. According to this constitution, when the thick sheet P passes by the registration roller pair 40, the sheet rear end can be prevented from strongly impacting with the left pre-transfer guide 37.

When the sheet P is conveyed to the secondary transfer portion S and the sheet rear end passes through the left pre-transfer guide 37, the rear end of the sheet P is hopped by the rigidity (stiffness) of the sheet P to collide with the intermediate transfer belt 16, for example. When the sheet rear end collides with the intermediate transfer belt 16 thus, the impact is transmitted to a transfer region of the intermediate transfer belt 16 to cause the transfer failure of the image formed on the sheet P.

Thus, in the present embodiment, in order to prevent the impact due to the hopping of the sheet P from being transmitted to the transfer region, the sheet-like impact absorption member 36 which is an elastic member is attached to the left pre-transfer guide 37 as a holding portion which holds the impact absorption member 36. The impact absorption member 36 is adhered and fixed to a fixed position (fixing portion) 37F on the upstream in the sheet conveying direction from the bent portion K of the left pre-transfer guide 37 and arranged to cross over the bent portion K.

The downstream end side of the impact absorption member 36 protrudes toward downstream in the sheet conveying direction from the left pre-transfer guide 37, that is, toward the secondary transfer portion (the downstream rotating member pair) in a state of being in contact with a front end portion 37X of the left pre-transfer guide 37. The downstream end side of the impact absorption member 36 is in contact with the front end portion 37X of the left pre-transfer guide 37, whereby the impact absorption member 36 is held by the left pre-transfer guide 37 in a state of being deflected toward the bent portion between a fixing portion 36H and the front end portion 37X of the left pre-transfer guide 37. Namely, the impact absorption member 36 is supported by the front end portion (supporting portion) 37X of the left pre-transfer guide 37 from the back surface of the impact absorption member 36 (the opposite side of the guide surface guided by the sheet) so as to be deflected on the downstream in the conveying direction from the fixing portion 36H. According to this constitution, the impact absorption member 36 in its portion downstream of the fixing portion 36H is deflected toward the bent portion, and, at the same time, in the thickness direction of the conveyed sheet the impact absorption member 36 is in such a state that the movement in a direction separate from the right pre-transfer guide 39 is controlled (restrained) by the front end portion 37X.

When the sheet rear end passes through the downstream end of the impact absorption member 36, the impact absorption member 36 is pressed by the sheet to be deflected toward the intermediate transfer belt. Namely, when the sheet rear end passes through the impact absorption member 36, the impact absorption member 36 is deflected toward the intermediate transfer belt along with the sheet. The impact absorption member 36 is deflected thus, whereby when the sheet separates from the impact absorption member 36, the sheet separates therefrom in a state of approaching toward the intermediate transfer belt, so that the impact generated when the sheet collides with the intermediate transfer belt 16 can be reduced.

In the present embodiment, the impact absorption member 36 is provided on the upstream in the sheet conveying direction from the bent portion K as described above and attached to the left pre-transfer guide 37 in a state of being deflected toward the bent portion. Thus, when the impact absorption member 36 is pressed by the sheet to be deflected, the impact absorption member 36 is deflected so that the front end approaches toward the intermediate transfer belt while eliminating the deflection toward the bent portion. According to this constitution, the sheet P separates from the impact absorption member 36 in a state of approaching the intermediate transfer belt 16, and consequently, the impact generated when the sheet P is in contact with the intermediate transfer belt 16 can be reduced.

The impact absorption member 36 is preferably formed of a material absorbing the vibration of the sheet and more preferably formed of a material having a smooth surface and rigidity in order to prevent catching of the sheet leading edge. The preferred materials include a synthetic resin film such as PET, polyimide, and polyethylene and a rubber material whose surface is coated with PTFE, PFA, and FEP, or polyimide, polyamide-imide, PEEK, PES, PPS, and so on.

Since a transfer current leakage due to conduction and an image failure due to frictional charging may occur, the impact absorption member 36 is conducted through the left pre-transfer guide 37 and a varistor (not illustrated) as described above. When the thickness of the impact absorption member 36 is too large, the deflection amount becomes small, and the impact absorption performance becomes insufficient. If the thickness is too small, the deflection amount is too large, and the impact absorption member 36 may be in contact with the intermediate transfer belt 16. The position of the impact absorption member 36 is regulated by not only the material and shape of the impact absorption member 36 but a range where the impact absorption member 36 is applied to the left pre-transfer guide 37 and a position where the impact absorption member 36 is in press contact with the conveying direction downstream side end of the left pre-transfer guide 37. When the positional relationship between the impact absorption member 36 and the intermediate transfer belt 16 is changed, the impact absorption performance is changed with the change of the positional relationship.

Thus, a test was performed to obtain a suitable thickness t of the impact absorption member 36 in the present embodiment, a width b in the conveying direction, and an application amount of a double-sided tape in use. In this test, while the thickness and application range of the impact absorption member 36 were changed, a degree of image blur was measured when sheets having a plurality of sizes are passed as a thick sheet having high rigidity (stiffness).

The sizes of the sheets used in the test were A3, A4, A4R, B4, B5, and B5R, and the measurement was performed using a printer having a process speed of 123 mm/sec and 80 mm/sec. As the impact absorption member 36 used in this test, plate materials constituted of a PET-based sheet having a width of 330 mm in the longitudinal direction are symmetrically arranged in the longitudinal direction with respect to the center of a sheet. In the impact absorption member 36, the width in the sheet conveying direction was 21 to 23 mm, the application amount of the impact absorption member 36 to the left pre-transfer guide 37 was 8 to 10 mm, and the thickness was 50 or 70 μm. The position in contact with the downstream guide of the bent portion K was fixed, and the image blur was measured.

FIG. 3 illustrates the results of the test (configuration optimization test of the impact absorption member) carried out about the degree of the image blur corresponding to the thickness t of the impact absorption member 36, the width b in the conveying direction, and the application amount of the both-side tape in use. Thus, as seen in FIG. 3, in the impact absorption member 36 of the present embodiment, it is preferable that the width in the conveying direction is 22 mm, the application amount is 9.5 mm, and the thickness is 75 μm. In this case, in the impact absorption member 36, the width in the conveying direction is 22 mm, and an adhesive tape for fixing the impact absorption member 36 to a conveying surface of the left pre-transfer guide 37 is applied to the back of 9.5 mm of the upstream width.

The width of the downstream, 12.5 mm, is not fixed to the left pre-transfer guide 37, whereby the impact absorption member 36 can be elastically curved by a contact with the sheet P. The impact absorption member 36 is in contact with the sheet conveying direction downstream side end of the left pre-transfer guide 37 at a position of 4.5 mm from the downstream front end, whereby the downstream side position of the impact absorption member 36 which is in a state of being deflected toward the bent portion is controlled.

If the application position of the impact absorption member 36 is arranged downstream of the bent portion K, the effect of preventing the hopping is reduced. When the impact absorption member 36 is fixed to the conveying surface, the sheet P may be caught by a step of the impact absorption member 36. When the impact absorption member 36 is fixed to the back surface of the conveying surface, a step is formed between the upper surface of the left pre-transfer guide 37 and the impact absorption member 36, and the image blur may occur when the sheet passes through the step.

In FIGS. 2A and 2B, FIG. 2B illustrates a state that, when a thick sheet 101*a* as an example of the sheet P with a large hopping is passed, the leading edge of the thick sheet 101*a* passes through the registration roller pair 40 and reaches the left pre-transfer guide 37. In a case where the thick sheet 101*a* having a large rigidity (large stiffness) and a large hopping is conveyed, when the thick sheet 101*a* is in contact with the left pre-transfer guide 37, the thick sheet 101*a* is vibrated by the impact due to the contact, so that the image blur may occur in the image transfer.

However, as described above, in the present embodiment, the impact absorption member 36 is arranged to be deflected toward the bent portion K while crossing over the bent portion K. As a result, as illustrated in FIGS. 2A and 2B, a space G is provided between (the bent portion K of) the left pre-transfer guide 37 and the impact absorption member 36. By virtue of the provision of the space G, the impact generated when the thick sheet 101*a* is in contact with the impact absorption member 36 is absorbed by the space G, and the image blur and so on can be reduced.

Figure 4A:
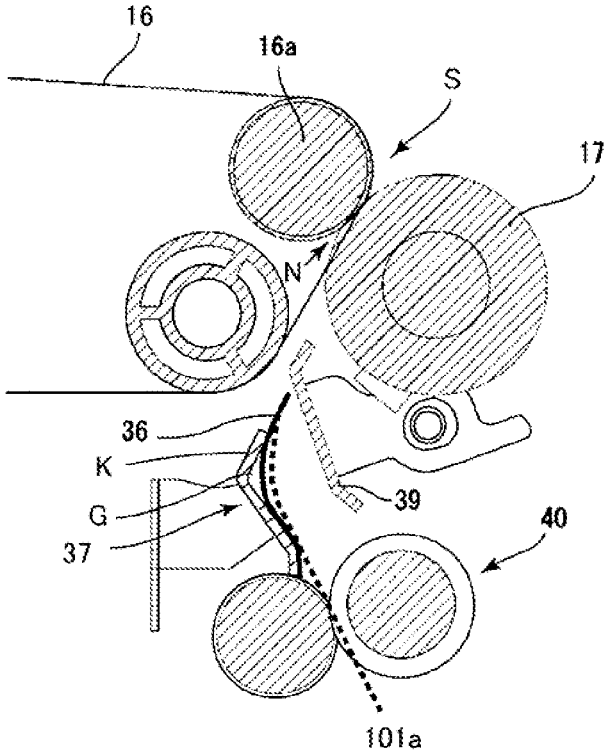
FIGS. 4A and 4B are first views for describing the operation of the impact absorption member.

FIG. 4A is a view illustrating a state when the leading edge of the thick sheet 101*a* passes through the bent portion K of the left pre-transfer guide 37 to be in contact with the downstream side end of the impact absorption member 36. The intermediate transfer belt 16 is provided on the downstream in the sheet conveying direction from the bent portion K, and when the thick sheet 101*a* is in contact with the intermediate transfer belt 16 in a state as it is on an upstream track of the bent portion K, the image blur and so on due to the impact may occur. However, as described above, in the present embodiment, the impact absorption member 36 is fixed on the upstream side of the bent portion K, whereby the sheet can be guided to a nip portion of the secondary transfer portion S while the impact absorption member 36 is deflected, so that the impact can be reduced.

Figure 4B:
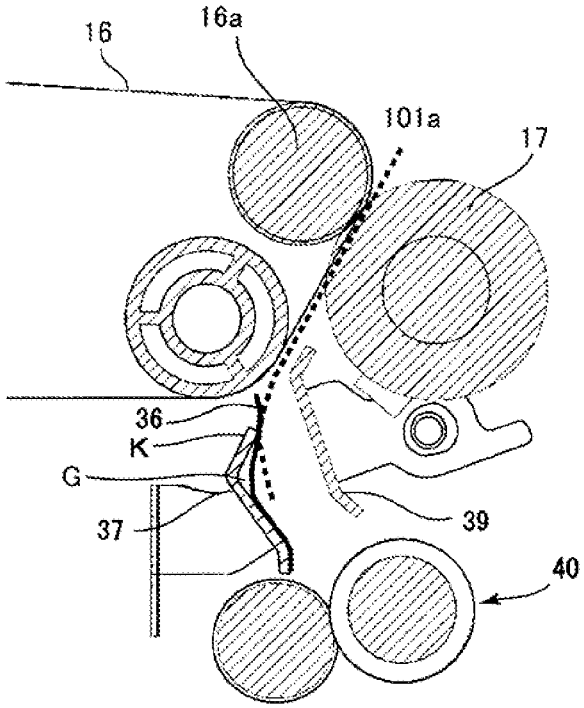

FIG. 4B is a view illustrating a state when the rear end of the thick sheet 101*a* passes through the bent portion K. The impact absorption member 36 is pressed by the restoring force due to the rigidity of the rear end side portion of the thick sheet 101*a*, conveyed by the intermediate transfer belt 16 and the secondary transfer roller 17, to be deformed as illustrated in FIG. 4B. As described above, by virtue of the bent portion K, the space G is formed between the left pre-transfer guide 37 and the impact absorption member 36. By virtue of the provision of the space G, the impact absorption member 36 is pressed by the rear end side of the thick sheet 101*a* to be allowed to deflect so that the front end approaches toward the intermediate transfer belt while eliminating the deflection toward the bent portion. Consequently, the hopping of the sheet rear end can be reduced, and therefore, even when the sheet rear end is hopped, the impact due to the hopping can be absorbed, so that the image blur and so on can be reduced.

Figure 5:
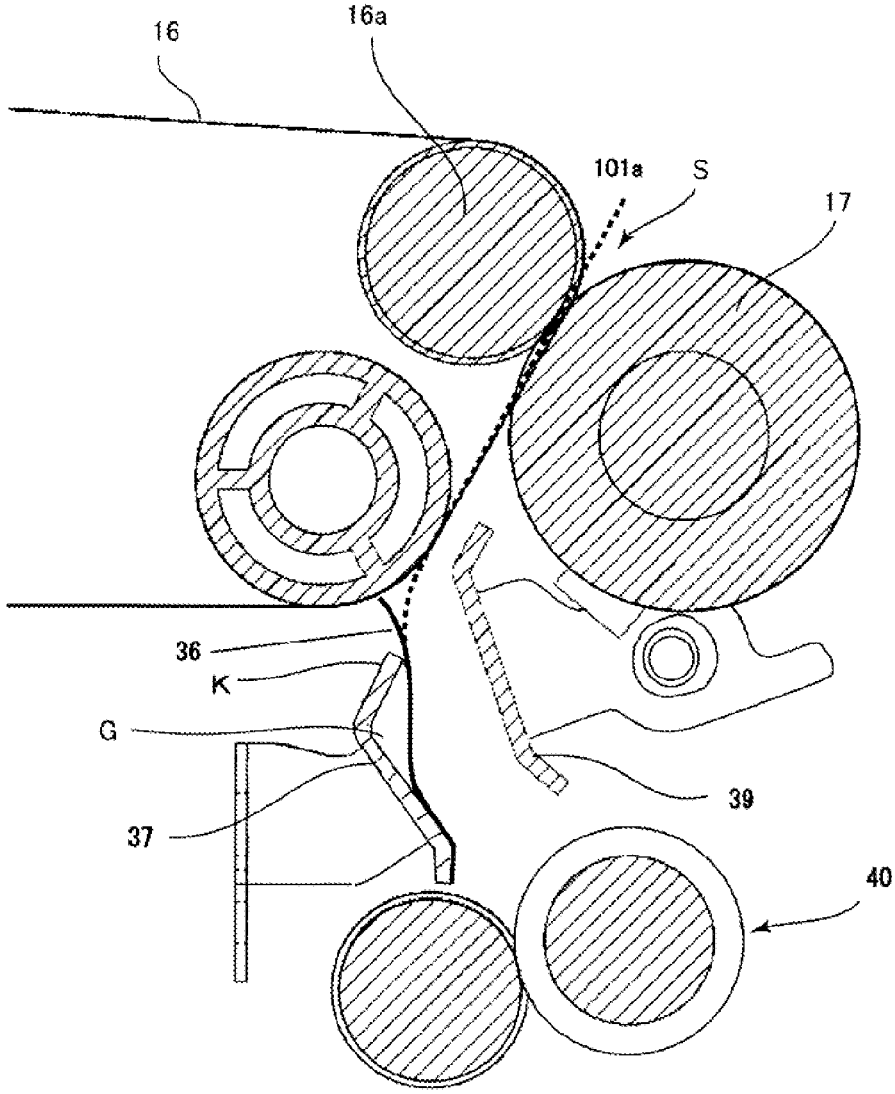
FIG. 5 is a second view for describing the operation of the impact absorption member.

FIG. 5 is a view illustrating a state immediately before the rear end of the thick sheet 101*a* passes through the impact absorption member 36. As illustrated in FIG. 5, when the rear end of the thick sheet 101*a* passes through the impact absorption member 36, the impact absorption member 36 is pressed by the restoring force due to the rigidity of the thick sheet 101*a* passed through the impact absorption member 36 while being deflected by the shape of the left pre-transfer guide 37, so that the conveying direction downstream side end of the impact absorption member 36 is deflected in the sheet restoring direction. When the impact absorption member 36 is deflected thus, the thick sheet 101*a* approaches the intermediate transfer belt 16, and thereafter, even if the thick sheet 101*a* collides with the intermediate transfer belt 16, the impact is reduced.

In the present embodiment, the impact absorption member 36 is fixed on the upstream side of the bent portion K so as to be deflected toward the bent portion and is in press contact with the conveying direction downstream end of the left pre-transfer guide 37. Thus, when the impact absorption member 36 is pressed by the thick sheet 101*a*, the impact absorption member 36 is drawn to be greatly deflected while enlarging the space G between the impact absorption member 36 and the left pre-transfer guide 37. As a result, the thick sheet 101*a* further approaches the intermediate transfer belt 16, and thereafter, even if the thick sheet 101*a* collides with the intermediate transfer belt 16, the impact is further reduced. According to this constitution, the impact due to the hopping of the rear end of the thick sheet 101*a* can be reduced, so that the image blur and so on can be reduced.

Namely, when the impact absorption member 36 is pressed by the sheet to be deformed in order to reduce the shock of the hopping of the sheet rear end, the impact absorption member 36 is deformed downstream of the fixing portion 36H of the impact absorption member 36. In the impact absorption member 36 of the present embodiment, the length of the portion that can be deflected (deformed) is long in comparison with, for example, such a constitution that an impact absorption member is deformed only in a portion downstream of a front end of a pre-transfer guide, and thus the shock absorption action is high.

As described above, in the present embodiment, the impact absorption member 36 is fixed on the upstream side of the bent portion K so as to be deflected toward the bent portion and is in press contact with the conveying direction downstream end of the left pre-transfer guide 37. According to this constitution, when the sheet passes through the left pre-transfer guide 37, the impact absorption member 36 is greatly deflected while being drawn (elongated) by the sheet. Namely, the impact absorption member 36 is deformed so that the deflected portion of the impact absorption member 36 is extended (straighten). Consequently, the deflection amount of the impact absorption member 36 is increased, and, as a result, the image blur occurring when a sheet having a large stiffness passes can be reduced.

When the leading edge of the sheet is guided toward the secondary transfer portion S, the impact absorption member 36 is somewhat deflected by the rigidity of the sheet; however, the thickness direction position of the sheet is specified by the front end portion 37X of the fixed pre-transfer left guide 37. Accordingly, the sheet is stabilized regardless of thickness thereof, that is, the thickness direction position of the sheet leading edge is stably set to a desired position, and meanwhile the leading edge of the sheet can be guided to the secondary transfer portion S.

In the present embodiment, in order to stably guide the sheet leading edge to the secondary transfer portion S, the distance between the front end portion 37X of the left pre-transfer guide 37 and the secondary transfer portion S is set to be short, and meanwhile the shock of the hopping of the sheet rear end occurring when the sheet rear end passes can be effectively reduced. As described above, the effective reduction of the shock of the hopping of the sheet rear end is realized by enabling the utilization of the deformation of the portion upstream of the portion that is downstream of the fixing portion 36H in the impact absorption member 36 and is supported by the front end portion 37X.

According to the material and configuration of the impact absorption member 36, a conveyance failure due to abrasion by wear, a transfer current leakage due to conduction, an image failure due to frictional charging, and so on may occur. Thus, in the present embodiment, an electroconductive member formed of high-density polyethylene, for example is applied to the conveying surface of the impact absorption member 36 to form an electroconductive portion, and the electroconductive portion and the left pre-transfer guide 37 are connected to be conducted. Since the thickness and rigidity of the impact absorption member 36 is greatly concerned with the impact absorption function, in the present embodiment the electroconductive member 38 (high-density polyethylene) with a thickness of 100 μm is applied to the impact absorption member 36 with the use of a thin adhesive tape of 30 μm. Consequently, the change of the rigidity is reduced, and the reduction of the image blur and the reduction of the image failure due to charging can be simultaneously realized.

Figure 6A:
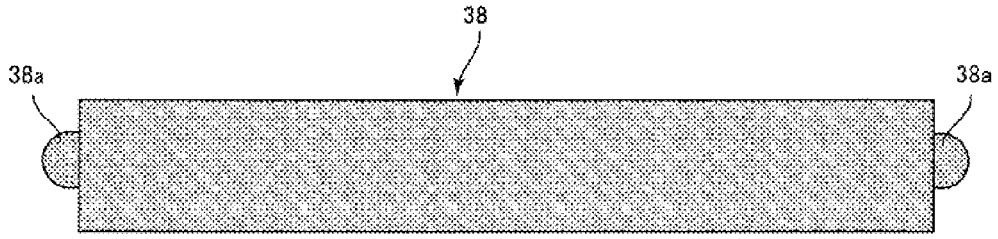
FIGS. 6A and 6B are views illustrating a configuration of an electroconductive member applied to the impact absorption member.
Figure 6B:
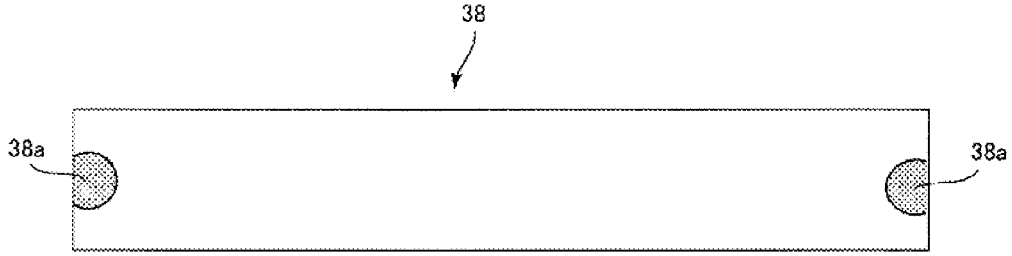

FIGS. 6A and 6B are views illustrating the electroconductive member 38 applied to the impact absorption member 36, formed of high-density polyethylene, for example, and having an electroconductivity. In the electroconductive member 38, only both end portions 38*a* have a small shape like an ear shape. The both end portions 38*a* are folded to be applied to the left pre-transfer guide 37 formed of an electroconductive material, and, thus, to be installed, whereby the electroconductive member 38 and the left pre-transfer guide 37 are conducted. FIG. 6A illustrates a state before the both end portions 38*a* are folded. FIG. 6B illustrates a state after the both end portions 38*a* are folded.

Since the both end portions 38*a* of the electroconductive member 38 are reduced in size, the peripheral adhesion portions remain when the both end portions 38*a* are folded, and the adhesion portions can be adhered to the left pre-transfer guide 37, so that floating of an end is prevented. Since the both end portions 38*a* of the electroconductive member 38 are provided in the left pre-transfer guide 37 in such a state that there is no adhesive tape, floating of the adhesive tape and charging due to peeling are concerned.

Thus, one of the both end portions 38*a* of the electroconductive member 38 is floated from the left pre-transfer guide 37, and the adhesive tape around the other end portion is removed. In this state, a change of a charge amount obtained was confirmed when a recycled paper and 200% DUTY image are passed. FIG. 7 illustrates a result of the test. As illustrated in FIG. 7, there is no tendency for the charge amount to increase. Thus, in the present embodiment, the both end portions 38*a* as parts of the electroconductive member 38 are folded.

In the present embodiment, although the left pre-transfer guide 37 and the right pre-transfer guide 39 are constituted of a single component, they may be constituted of plural components. Also in this case, the impact absorption member 36 is not changed, and the application range of the adhesive tape and a contact point of the conveying direction downstream side end of the left pre-transfer guide 37 are the same in the conveying direction, so that a similar effect can be exercised.

Figure 8:
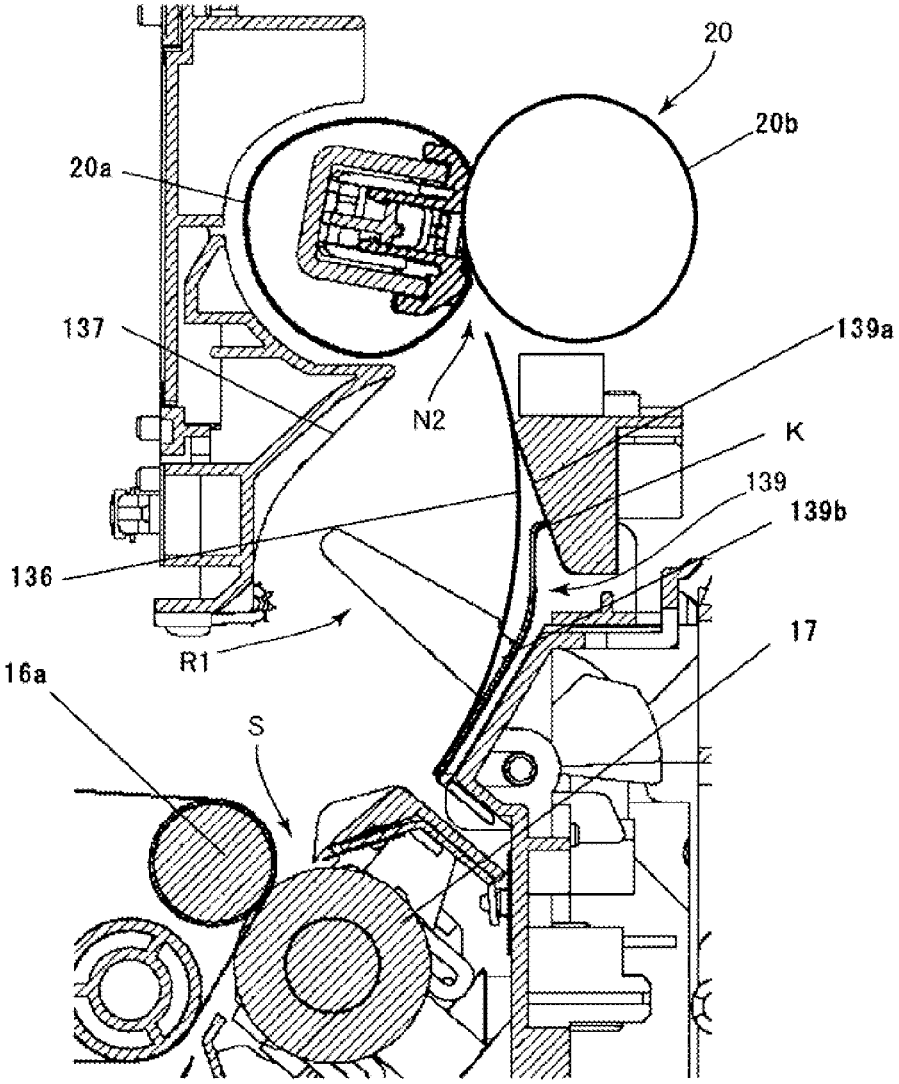
FIG. 8 is a view illustrating a configuration near a secondary transfer portion and a fixing portion of a sheet conveying apparatus according to a second embodiment of the present invention.

Next, a second embodiment of the present invention will be described. In the first embodiment, although the impact absorption member is provided in the upstream sheet conveying path of the image forming portion 1B, in the second embodiment the impact absorption member is provided in the downstream sheet conveying path of the image forming portion 1B. FIG. 8 is a view illustrating a configuration near a secondary transfer portion and a fixing portion of a sheet conveying apparatus according to the second embodiment of the present invention. In FIG. 8, the same reference numerals as those of FIGS. 2A and 2B denote the same or corresponding components.

In FIG. 8, a curved sheet conveying path R1 is provided between a secondary transfer portion S and a fixing portion 20 and guides a sheet, passed through the secondary transfer portion S, to the fixing portion 20. A left pre-fixing guide 137 and a right pre-fixing guide 139 are located on the sheet conveying direction downstream of a sheet conveying path R1 and guide the sheet to the fixing portion 20.

As illustrated in FIG. 8, the fixing portion 20 has a heat source required for fixing and is constituted of a fixing film unit 20*a* rotated by receiving a drive force and a pressure roller 20*b* connected to a drive of the fixing film unit 20*a* and pressurizing and rotating the fixing film unit 20*a*. The sheet passed through the secondary transfer portion S is conveyed to a fixing nip N2 formed by the fixing film unit 20*a* and the pressure roller 20*b* while being guided by the left pre-fixing guide 137 and the right pre-fixing guide 139. In the present embodiment, a drive roller 16*a* and the secondary transfer roller 17 constitute an upstream rotating member pair, and the fixing film unit 20*a* and the pressure roller 20*b* constitute a downstream rotating member pair.

In FIG. 8, an impact absorption member 136 is provided in the right pre-fixing guide 139. The impact absorption member 136 is provided in the right pre-fixing guide 139, and a sheet is conveyed while forming a fixed loop, that is, being deflected toward the right pre-fixing guide 139, whereby a toner image forming surface is not in contact with the left pre-fixing guide 137.

The left pre-fixing guide 137 and the right pre-fixing guide 139 have, on the conveying direction downstream, guide shapes curved along the fixing film unit 20*a* and the pressure roller 20*b* so that a sheet P smoothly enters the fixing nip N2. An interval in the sheet thickness direction of the conveying direction upstream side end between the left pre-fixing guide 137 and the right pre-fixing guide 139 is enlarged so that the sheet conveyed from the secondary transfer portion S is easily received.

The right pre-fixing guide 139 includes an upstream guide portion 139*a* and a downstream guide portion 139*b*, and an intersection between these two components is a bent portion K. Namely, the downstream guide portion 139*b* is provided with respect to the upstream guide portion 139*a* in a state of forming a predetermined angle at which the sheet can smoothly enter the fixing nip N2. The impact absorption member 136 is adhered and fixed to the upstream guide portion 139*a* of a right pre-fixing guide 139 and arranged in a state of crossing over the bent portion K, formed by the upstream guide portion 139*a* and the downstream guide portion 139*b* and otherwise, while being deflected toward the bend portion K.

When the sheet rear end passes through the right pre-fixing guide 139, the impact absorption member 136 reduces an impact generated when the hopped sheet rear end is in contact with the fixing portion 20 and prevents the impact from being transmitted to an image being fixed. The impact absorption member 136 is deflected to absorb the impact and has a function of guiding to the fixing nip. As in the present embodiment, the impact absorption member 136 is fixed to the upstream of the bent portion K, that is, the upstream guide portion 139*a*, whereby the deflection amount can be increased, and the impact can be reduced.

The impact absorption member 136 is preferably formed of an elastic member absorbing the vibration of the sheet and more preferably formed of a material having a smooth surface and rigidity in order to prevent catching of the sheet leading edge. The preferred materials include a synthetic resin film such as PET, polyimide, and polyethylene and a rubber material whose surface is coated with PTFE, PFA, and FEP, or polyimide, polyamide-imide, PEEK, PES, PPS, and so on. When the thickness of the impact absorption member is too large or too small, the impact absorption performance becomes insufficient. Accordingly, in the present embodiment, the absorption performance of the impact absorption member 136 is regulated by changing not only the material and thickness of the impact absorption member 136 but a range where the impact absorption member 136 is applied to the upstream guide portion 139*a* and a position where the impact absorption member 136 is in contact with the conveying direction downstream side end of the downstream guide portion 139*b*.

As in the present embodiment described above, the right pre-fixing guide 139 includes the upstream guide portion 139*a* and the downstream guide portion 139*b*, and the intersection between these two components is the bent portion K. The impact absorption member 136 is arranged in the bent portion K in a state of being fixed to the upstream guide portion 139*a* and deflected toward the bent portion K, whereby the deflection amount of the impact absorption member 136 can be increased. A range where the impact absorption member 136 is fixed to the upstream guide portion 139*a* is regulated as well as the thickness and material of the impact absorption member 136, whereby the impact absorption performance can be set.

In the present embodiment, although the impact absorption member 136 is provided in the sheet conveying path of the fixing portion 20, in a switchback device having a back-side printing function and a folding function, the impact absorption member 136 can be used in a sheet conveying path in which the sheet conveying direction is changed at a short distance.

In the above description, although the present invention is applied to the sheet conveying apparatus of a color laser printer including the sheet conveying path extending vertically, the present invention is not limited thereto. For example, the present invention is applicable to an image forming apparatus including a sheet conveying path extending horizontally and a monochrome laser printer as long as it includes a sheet conveying path curved between two roller pairs.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-267566, filed Nov. 30, 2010, which is hereby incorporated by reference herein in its entirety.

What is claimed is:

1. The sheet conveying apparatus, comprising:
- an upstream rotating member pair configured to convey a sheet;
- a downstream rotating member pair, configured to convey the sheet, provided downstream of the upstream rotating member pair in a conveying direction;
- an elastic member configured to guide the sheet from the upstream rotating member pair to the downstream rotating member pair; and
- a guide member having,
- a bent portion, which is bent,
- a fixed portion, provided upstream of the bent portion in the conveying direction, configured to fix a upstream portion of the elastic member in the conveying direction, and
- a supporting portion, provided downstream of the bent portion in the conveying direction, configured to support the elastic member from an opposite side of a guide surface of the elastic member guiding the conveyed sheet so that a portion of the elastic member between the fixing portion and the support portion is deflected,
- wherein the elastic member is attached to the guide member in a state of being deflected while forming a space with the bent portion of the guide member.

2. The sheet conveying apparatus according to claim 1, when the elastic member is pressed by a restoring force due to the rigidity of the sheet, a portion of the elastic member protruding more toward the downstream rotating member pair than the supporting portion is deflected in a sheet restoring direction, and a portion of the elastic member between the fixed portion and the supporting portion is deformed such that it is decreased by the deflected amount.

3. The sheet conveying apparatus according to claim 1, wherein the downstream rotating member pair includes a transfer portion which transfers a toner image onto the sheet.

4. The sheet conveying apparatus according to claim 1, wherein the downstream rotating member pair includes a fixing portion which fixes the image on the sheet.

5. The sheet conveying apparatus according to claim 1, wherein the guide member has an electroconductivity.

6. The sheet conveying apparatus according to claim 5, wherein the elastic member includes a sheet-like electroconductive member having the guide service, the elastic member is fixed by an adhesive tape on the fixed portion, and a part of the electroconductive member is folded to be in contact with the guide member.

7. The sheet conveying apparatus according to claim 1, wherein a downstream end portion of the elastic member protrudes toward the downstream rotating member pair from the supporting portion, and wherein a portion of the elastic member protruded from the supporting portion and a portion of the elastic member between the fixing portion and the support portion are deformed by being pressed by a rear end portion of the sheet conveyed by the downstream rotating member pair.

8. An image forming apparatus comprising:

a transfer nip portion comprised a belt bearing toner images and a transfer roller which transfer the toner image on the belt onto a sheet, a transfer roller pair which send the sheet to the transfer nip portion, an elastic member configured to guide the sheet from the transfer roller pair to the transfer nip portion, and a guide member having, a bent portion which is bent, a fixed portion, provided upstream of the bent portion in the conveying direction, configured to fix a upstream portion of the elastic member in the conveying direction, and a supporting portion, provided downstream of the bent portion in the conveying direction, configured to support the elastic member from an opposite side of a guide surface of the elastic member guiding the conveyed sheet so that a portion of the elastic member between the fixing portion and the support portion is deflected, wherein the elastic member is attached to the guide member in a state of being deflected while forming a space with the bent portion of the guide member.

9. The image forming apparatus according to claim 8, wherein when the elastic member is pressed by a restoring force due to the rigidity of the sheet, a portion of the elastic member protruding more toward the downstream rotating member pair than the supporting portion is deflected in a sheet restoring direction, and a portion of the elastic member between the fixed portion and the supporting portion is deformed such that it is decreased by the deflected amount.

10. The image forming apparatus according to claim 8, wherein the guide member has an electroconductivity.

11. The image forming apparatus according to claim 10, wherein the elastic member includes a sheet-like electroconductive member having a smooth surface on a surface through which the sheet passes, and a part of the electroconductive member is folded to be in contact with the guide member.

12. The image forming apparatus according to claim 8, wherein a downstream end portion of the elastic member protrudes toward the downstream rotating member pair from the supporting portion, wherein a portion of the elastic member protruded from the supporting portion and a portion of the elastic member between the fixing portion and the support portion are deformed by being pressed by a rear end portion of the sheet conveyed by the downstream rotating member pair.

13. The image forming apparatus according to claim 8, wherein the supporting portion of the guide member is a part elongating along a surface of the belt.

14. The image forming apparatus according to claim 8, wherein the fixed portion involves a secondary bent portion which is disposed at upstream side and the fixing holds upstream portion of the elastic member.

15. A sheet conveying apparatus comprising:

an upstream rotating member pair configured to convey a sheet;

a downstream rotating member pair, configured to convey the sheet, provided downstream of the upstream rotating member pair in a conveying direction;

an elastic member configured to guide the sheet from the upstream rotating member pair to the downstream rotating member pair and to deform by being pressed by a rear end portion of the sheet conveyed by the downstream rotating member pair;

a fixing portion configured to fix the elastic member; and a supporting portion, provided downstream of the fixing portion in the conveying direction, configured to support the elastic member from an opposite side of a guide surface of the elastic member guiding the conveyed sheet, wherein a downstream end portion of the elastic member protrudes toward the downstream rotating member pair from the supporting portion, wherein the downstream end portion of the elastic member protruded from the supporting portion and a portion of the elastic member between the fixing portion and the support portion are deformed by being pressed by the rear end portion of the sheet conveyed by the downstream rotating member pair.

16. The sheet conveying apparatus according to claim 15, wherein when the elastic member is pressed by a restoring force due to the rigidity of the sheet, a portion of the elastic member protruding more toward the downstream rotating member pair than the supporting portion is deflected in a sheet restoring direction, and a portion of the elastic member between the fixed portion and the supporting portion is deformed such that it is decreased by the deflected amount.

17. The sheet conveying apparatus according to claim 15, wherein the downstream rotating member pair includes a transfer portion which transfers a toner image onto the sheet.

18. The sheet conveying apparatus according to claim 15, wherein the downstream rotating member pair includes a fixing portion which fixes the image on the sheet.

19. The sheet conveying apparatus according to claim 15, wherein the guide member has an electroconductivity.

20. The sheet conveying apparatus according to claim 19, wherein the elastic member includes a sheet-like electroconductive member having the guide surface, the elastic member is fixed by an adhesive tape on the fixed portion, and a part of the electroconductive member is folded to be in contact with the guide member.

21. The sheet conveying apparatus according to claim 15, further comprising a guide member having:

a bent portion which is bent, the fixed portion provided upstream of the bent portion in the conveying direction, and the supporting portion provided downstream of the bent portion in the conveying direction, wherein the supporting portion supports the elastic member so that the portion of the elastic member between the fixing portion and the support portion is deflected, wherein the elastic member is attached to the guide member in a state of being deflected while forming a space with the bent portion of the guide member.

22. The sheet conveying apparatus according to claim 15, wherein the supporting portion supports the elastic member so that the portion of the elastic member between the fixing portion and the support portion is deflected.

* * * * *